US009101185B1

(12) United States Patent
Greenberg

(10) Patent No.: US 9,101,185 B1
(45) Date of Patent: Aug. 11, 2015

(54) JEWELRY CLASP

(71) Applicant: William Greenberg, Lincoln, RI (US)

(72) Inventor: William Greenberg, Lincoln, RI (US)

( * ) Notice: Subject to any disclaimer, the term of this patent is extended or adjusted under 35 U.S.C. 154(b) by 0 days.

(21) Appl. No.: 14/246,514

(22) Filed: Apr. 7, 2014

Related U.S. Application Data

(60) Provisional application No. 61/817,558, filed on Apr. 30, 2013.

(51) Int. Cl.

| | |
|---|---|
| ***A44C 5/20*** | (2006.01) |
| ***A44C 5/18*** | (2006.01) |
| ***A44C 5/00*** | (2006.01) |
| ***H01F 7/02*** | (2006.01) |
| ***A45C 13/10*** | (2006.01) |
| ***E05C 19/16*** | (2006.01) |

(52) U.S. Cl.
CPC ..... *A44C 5/20* (2013.01); *A45C 13/1069* (2013.01); *E05C 19/16* (2013.01); *H01F 7/0263* (2013.01); *Y10T 24/32* (2015.01)

(58) Field of Classification Search
CPC ..... Y10T 24/32; H01F 7/0263; A44C 5/20; A45C 13/1069; E05C 19/16
See application file for complete search history.

(56) References Cited

U.S. PATENT DOCUMENTS

| | | | | |
|---|---|---|---|---|
| 3,041,697 | A * | 7/1962 | Budreck | 24/303 |
| 3,589,341 | A * | 6/1971 | Krebs | 119/865 |
| 4,231,137 | A | 11/1980 | Fujimoto | |
| 4,622,726 | A * | 11/1986 | Nakamura | 24/574.1 |
| 4,630,452 | A | 12/1986 | Connelly et al. | |
| 6,292,985 | B1 * | 9/2001 | Grunberger | 24/303 |
| 6,848,288 | B1 | 2/2005 | Derman | |
| 7,207,091 | B2 * | 4/2007 | Dunaye | 24/303 |
| 7,690,088 | B2 | 4/2010 | Kogen | |
| 8,359,716 | B2 * | 1/2013 | Fiedler | 24/303 |
| 8,752,252 | B2 * | 6/2014 | Ninomiya et al. | 24/303 |
| 2002/0112323 | A1 * | 8/2002 | Nire | 24/303 |
| 2003/0005558 | A1 * | 1/2003 | Wong | 24/303 |
| 2009/0106944 | A1 * | 4/2009 | Hsu | 24/3.4 |
| 2012/0000038 | A1 | 1/2012 | Humphries et al. | |
| 2012/0044031 | A1 * | 2/2012 | Ninomiya | 335/219 |
| 2012/0216374 | A1 | 8/2012 | Manuello | |

* cited by examiner

*Primary Examiner* — Robert J Sandy
*Assistant Examiner* — Louis Mercado
(74) *Attorney, Agent, or Firm* — Salter & Michaelson

(57) ABSTRACT

A jewelry clasp includes a first clasp housing piece, and a second clasp housing piece. The first and second clasp housing pieces each have an internal support surface and respective interface surfaces that are constructed and arranged to provide a mating fit between the first and second clasp housing pieces. A first magnetic attraction member is disposed at the internal support surface of the first clasp housing piece and a second magnetic attraction member is disposed at the internal support surface of the second clasp housing piece. The interface surfaces are separately disposed inclined plane surfaces including at least a first inclined surface that is inclined in a direction longitudinal of the clasp, and at least a second inclined surface that is a directed in a direction transverse to the longitudinal axis of the clasp.

18 Claims, 9 Drawing Sheets

JEWELRY CLASP

RELATED CASES

Priority for this application is hereby claimed under 35 U.S.C. §119(e) to commonly owned U.S. Provisional Patent Application No. 61/817,558 which was filed on Apr. 30, 2013 and which is incorporated by reference herein in its entirety.

FIELD OF THE INVENTION

The present invention relates in general to a jewelry clasp. More particularly, the invention also relates to a jewelry clasp that is effective in use in that it is easily manipulable by the user.

BACKGROUND OF THE INVENTION

Many existing jewelry clasps, particularly for with, for example, a necklace, are difficult to clasp and unclasp. This clasping and unclasping is particularly difficult when attempting to secure the necklace at the back of one's neck. It is impossible to see the clasp, and thus there is added difficulty in attaching and detaching the clasp. With a conventional clasp this is hit or miss proposition and very often requires the help of a second person who stands behind the user to see and secure the clasp together.

Accordingly, it is an object of the present invention to provide an improved jewelry clasp in which the clasp in particular has improved interlock between the separate members of the clasp.

Another object of the present invention is to provide an improved jewelry clasp employing magnetic forces for attraction of the clasp components.

Still another object of the present invention is to provide a magnetic arrangement clasp that provides sufficient strength.

A further object of the present invention is to provide an improved clasp mechanism with particular structural features associated with the clasps members that enhance the clasping action and make the mating and release of the clasp very easy to perform.

SUMMARY OF THE INVENTION

To accomplish the foregoing and other objects, features and advantages of the present invention there is provided a jewelry clasp that is comprised of separate, inter-engageable clasp members, each clasp member supporting a magnetic attraction member and having respective interfacing surfaces including separately disposed inclined plane surfaces about the magnetic attraction member. The separately disposed inclined plane surfaces include at least a first inclined surface that is inclined in a direction longitudinal of the clasp, and at least a second inclined surface that is a directed in a direction transverse to the longitudinal axis of the clasp.

In accordance with other aspects of the present invention the at least a second inclined surface includes a second inclined surface and a third inclined surface; the second inclined surface and the third inclined surface are disposed adjacent to each other; both the second inclined surface and the third inclined surface are directed in a direction transverse to the longitudinal axis of the clasp; the second inclined surface extends facing inwardly of the clasp member and a third inclined surface extends facing outwardly of the clasp member; the first inclined surface has a lower end and a peak end; the second inclined surface extends facing inwardly of the clasp member at the peak end of the first inclined surface and the third inclined surface extends facing outwardly of the clasp member at the lower end of the first inclined surface; and each clasp member has a pair of first inclined surfaces that are inclined in the same direction and that separated by a middle portion that supports a respective magnetic attraction member.

In accordance with another embodiment of the present invention there is provided a jewelry clasp comprising:

a first clasp housing piece;

a second clasp housing piece;

said first and second clasp housing pieces each having an internal support surface and respective interface surfaces that are constructed and arranged to provide a mating fit between the first and second clasp housing pieces;

a first magnetic attraction member disposed at the internal support surface of the first clasp housing piece; and a second magnetic attraction member disposed at the internal support surface of the second clasp housing piece.

In accordance with still other aspects of the present invention the respective interface surfaces include side-disposed inclined or tapered edge pieces on either side of the internal support surface; the respective magnetic attraction members each have a substantially flat contact surface that extends in a substantially longitudinal direction between the first and second clasp housing pieces; the internal support surface also extends substantially in a longitudinal direction between the first and second clasp housing pieces between the first and second clasp housing pieces; each clasp housing piece includes an elongated channel for receiving a chain, cord or the like including an end recess; each interface surface is S-shaped that is formed at least in part by an extending leg; each of the magnetic attraction members is supported at one of the legs; the respective interface surfaces include side-disposed inclined plane surfaces on either side of the internal support surface, said side-disposed inclined plane surfaces including at least a first inclined surface that is inclined in a direction longitudinal of the clasp, and at least a second inclined surface that is a directed in a direction transverse to the longitudinal axis of the clasp; the at least a second inclined surface includes a second inclined surface and a third inclined surface; the second inclined surface and the third inclined surface are disposed adjacent to each other, and wherein both the second inclined surface and the third inclined surface are directed in a direction transverse to the longitudinal axis of the clasp; the second inclined surface extends facing inwardly of the clasp member and a third inclined surface extends facing outwardly of the clasp member; and the first inclined surface has a lower end and a peak end, and wherein the second inclined surface extends facing inwardly of the clasp member at the peak end of the first inclined surface and the third inclined surface extends facing outwardly of the clasp member at the lower end of the first inclined surface.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

In accordance with the present invention there is provided a clasp that has attractive magnets disposed in respective clasp members and employs inclined planes in the structure of these members. In one preferred embodiment one of the planes is a longitudinal plane, and the other is a lateral plane to the main axis. In some embodiments of the present invention the clasp members are arranged with a step at right angles and in other embodiments of the present invention to be described hereinafter, there is a curve, such as an S-shaped curve to the structure with the inclined planes being within this curved structure. The overall cross-section (across X axis), overall plan form as seen from the top (Z axis) and the overall plan as seen from the side (Y axis) can be of many different sizes and shapes. Axis X is considered the clasp longitudinal axis.

The present invention has a structure, as mentioned previously, preferably employing orthogonal inclined planes. This provides a particular physical arrangement that lends itself to enhanced clasping forces in combination with the attractive magnets that are provided. It is the combination of the magnets and these inclined planes that provide a strong securing between the clasp members making it difficult to pull the two clasp members apart. The inclined planes change the longitudinal motion into a vertical motion where the magnets are located. The vertical separation is resisted by the attraction of the magnets (electromagnetic force). The inclined planes are designed steep enough so that the longitudinal and lateral forces are great enough to keep the clasp together. The strength of the magnets are designed and the shapes of the ramps and curves to allow and facilitate the wearer to deliberately overcome the attractive force of the magnets with a longitudinal pull, or manual torques as applied by the wearer's fingers either in the X, Y or Z directions. The ramps and curves initially cause the magnets to separate slightly but enough to permit the wearer to continue the motion of the fingers and arms to complete the separation of the clasp. Also note that as a benefit, the ramps and curves cause the exact alignment of the clasp when the wearer "snaps" together a necklace or bracelet, even when doing so, in the case of a necklace, in the back of one's neck when one cannot see. Doing this with a conventional clasp is hit or miss and very often requires the help of a second person who stands behind to see and do the actual clasping. The device of the present invention allows quick and easy attachment and detachment with very little strength or concern. The exact angle of the inclined plans and the radius of the curves are variable.

Figure 1:
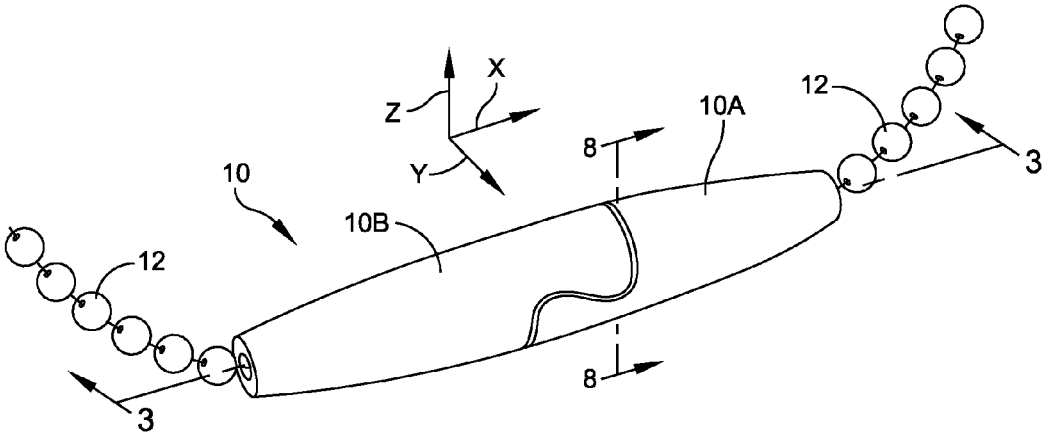
FIG. 1 is a perspective view of the first embodiment of the present invention.
Figure 2:
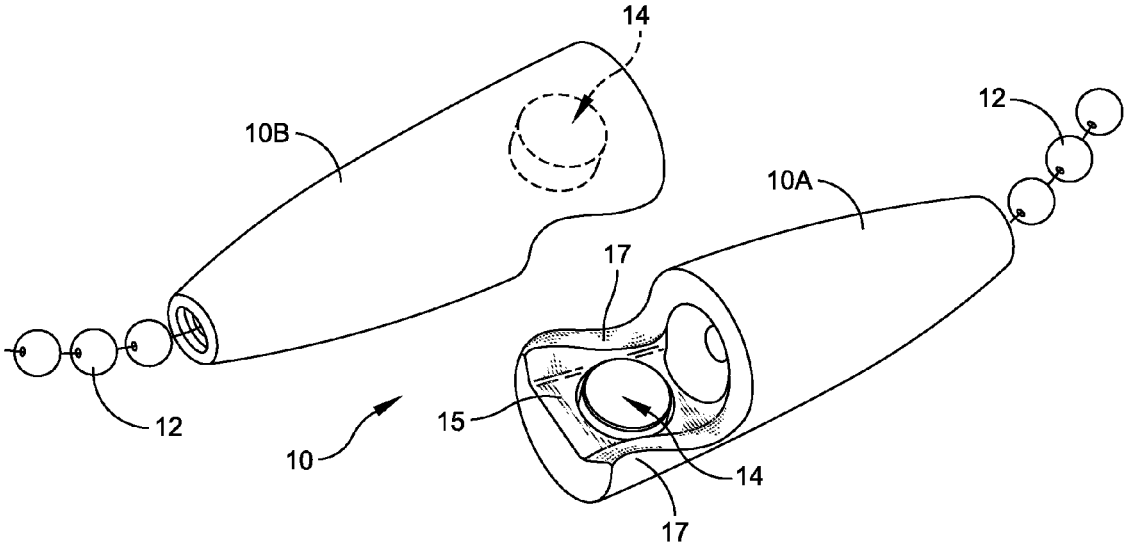
FIG. 2 is a exploded perspective view of the embodiment illustrated in FIG. 1.
Figure 3:
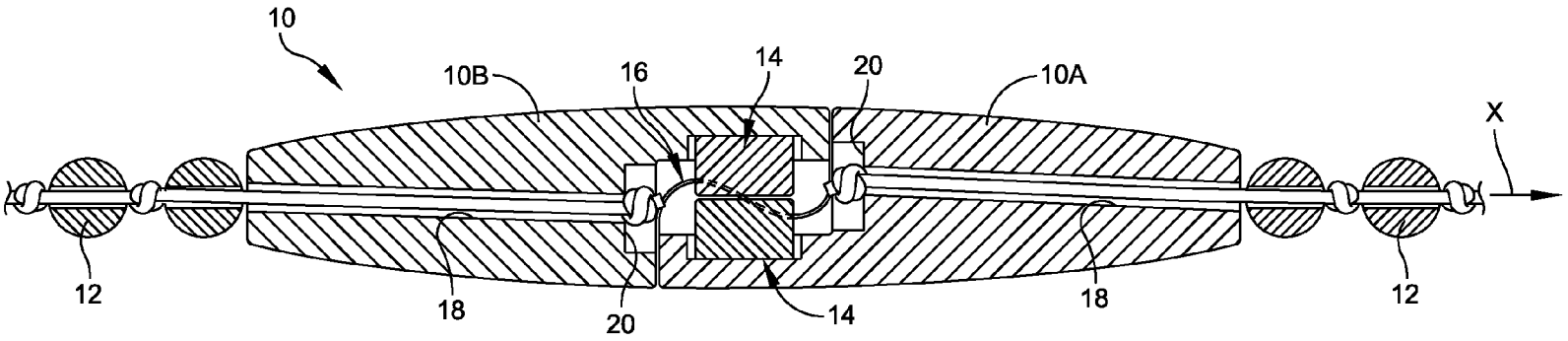
FIG. 3 is a cross-sectional view through a slightly different embodiment than that described in FIGS. 1 and 2.
Figure 4:
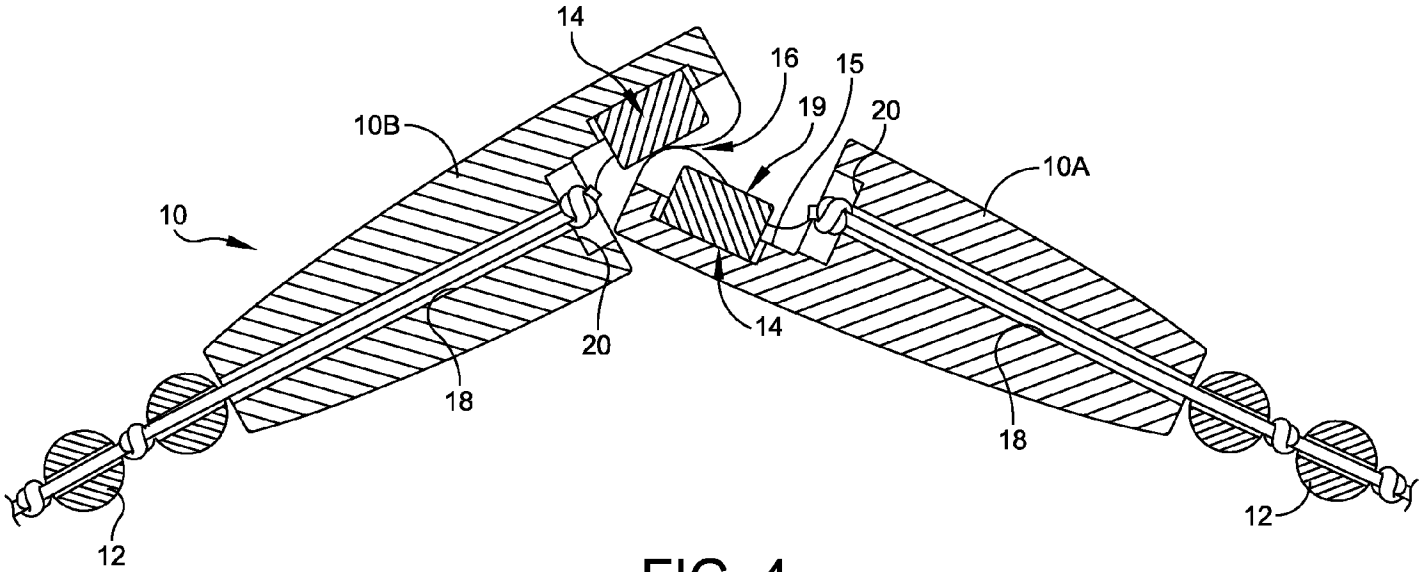
FIG. 4 is a cross-sectional view like that illustrated in FIG. 3 showing the disengagement between the clasp members.
Figure 5:
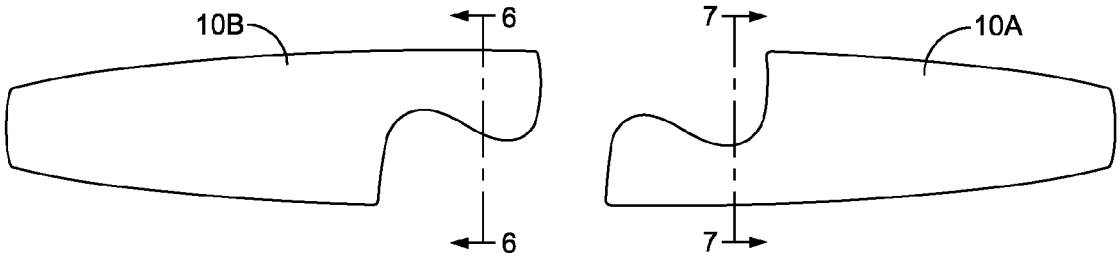
FIG. 5 is schematic diagram illustrating the separate clasp members.
Figure 6:
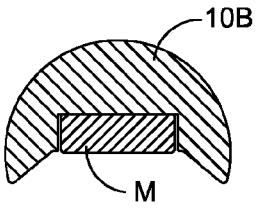
FIG. 6 is a cross-sectional view taken along Line 6-6 of FIG. 5.
Figure 7:
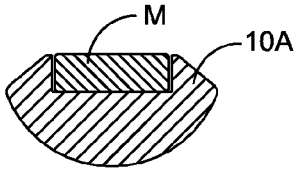
FIG. 7 is a cross-sectional view taken along Line 7-7 of FIG. 5.
Figure 8:
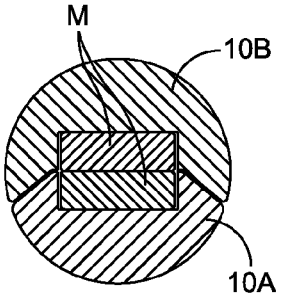
FIG. 8 is a cross-sectional view illustrating the clasp members engaged.
Figure 9:
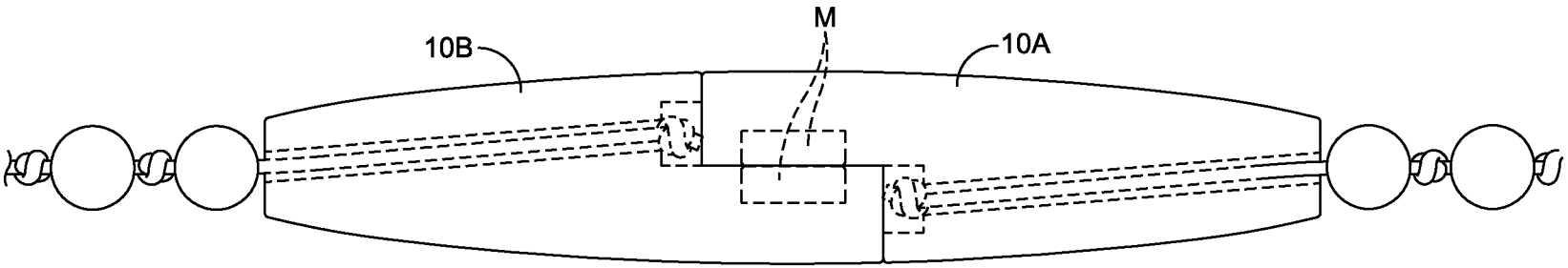
FIG. 9 is a side elevation view of the clasp of the present invention illustrating the clasp members and magnets.

Reference is now made to a first embodiment of the present invention such as illustrated in FIGS. 1-9. The clasp 10 is comprised of two separate clasp housing pieces or halves 10A and 10B with a right angle step between them as illustrated in the drawing, and in particular in FIGS. 3 and 4. The idea to this clasp is to make it as easy as possible to attach and release for a woman when she puts jewelry in a necklace around her neck, or even when the principles are applied to a bracelet. The clasp includes mating magnets shown at 14 which are on the side of the step. When the two separate pieces come into close contact with each other, the magnets will attract and thus provide a closure of the clasp. The two parts 10A and 10B can be simply released by pivoting one part relative to the other such as at the pivot point 16 thus breaking the attraction between the magnets. One important aspect of this is that the magnets are arranged on a side of the step, such as illustrated in FIGS. 3 and 4.

Thus, as particularly shown in FIG. 3 when the magnets are in their attached state the interfacing and touching surfaces are essentially in line with the longitudinal axis X, as well as in line with the channels 18. FIG. 4 shows one way of easily releasing the clasp at the pivot point 16 thus breaking the attraction between the magnets. This pivoting action is a simple way to provide an effective release of the clasp pieces 10A, 10B. The two housing pieces may also be released by manipulation therebetween in other axis directions. Although separate magnets 14 are illustrated, it should be understood that other forms of attraction may be employed. For example, a single magnet may be used in combination with a second magnetic attraction member such as a ferromagnetic piece. The important aspect is that there is an attraction force between the housing pieces when they are in sufficient close location.

The string of beads is usually attached by some type of a string or wire that is adapted to pass through separate channel 18. This string can be tied at a knot that would be disposed within the end recess 20. This thus allows for a relatively simple construction for securing and releasing the clasp while at the same time enabling attachment of the string or wire through the channel 18 into the recess 20.

The first and second clasp housing pieces each have an internal support surface 15 and respective interface surfaces 17 that are constructed and arranged to provide a mating fit between the first and second clasp housing pieces 10A, 10B. The respective interface surfaces 17 may be comprised of side-disposed inclined or tapered edge pieces on either side of the internal support surface 15. The respective magnetic attraction members 14 may each have a substantially flat contact surface 19 that extends in a substantially longitudinal direction (axis X) between the first and second clasp housing pieces 10A, 10B, when assembled such as shown in FIG. 3.

Figure 12:
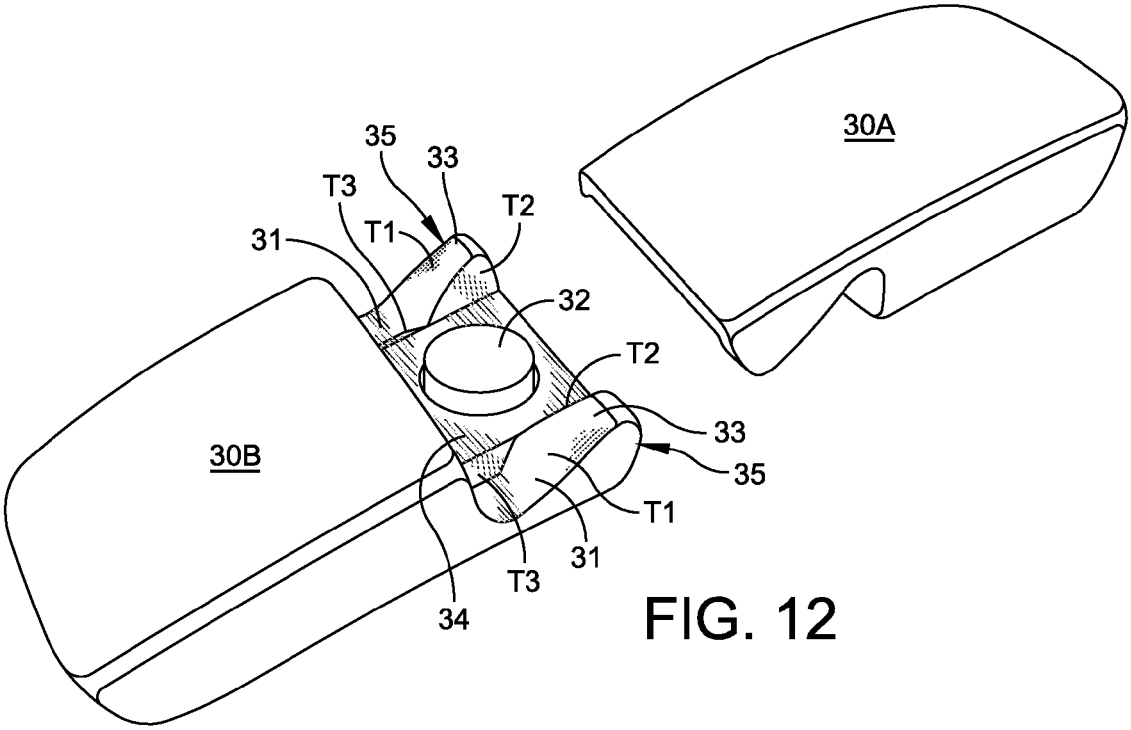
FIG. 12 is a exploded perspective view showing the structure of one of the clasp members.
Figure 13:
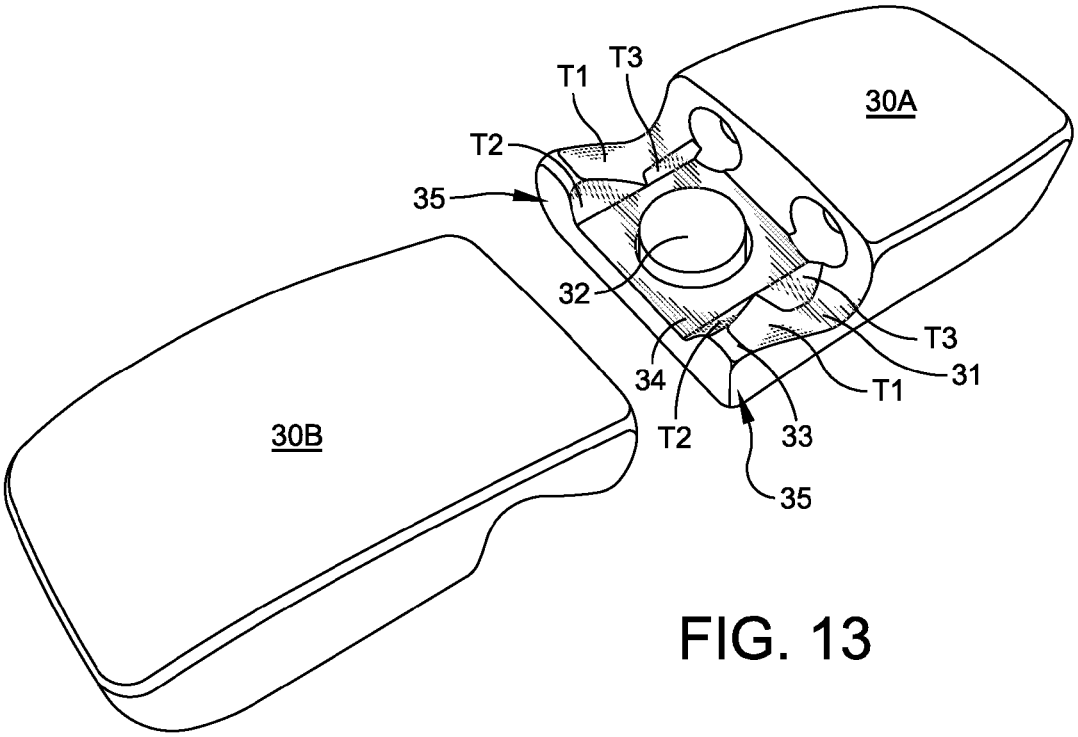
FIG. 13 is an exploded perspective view illustrating further structural details of the other clasp members.
Figure 13A:
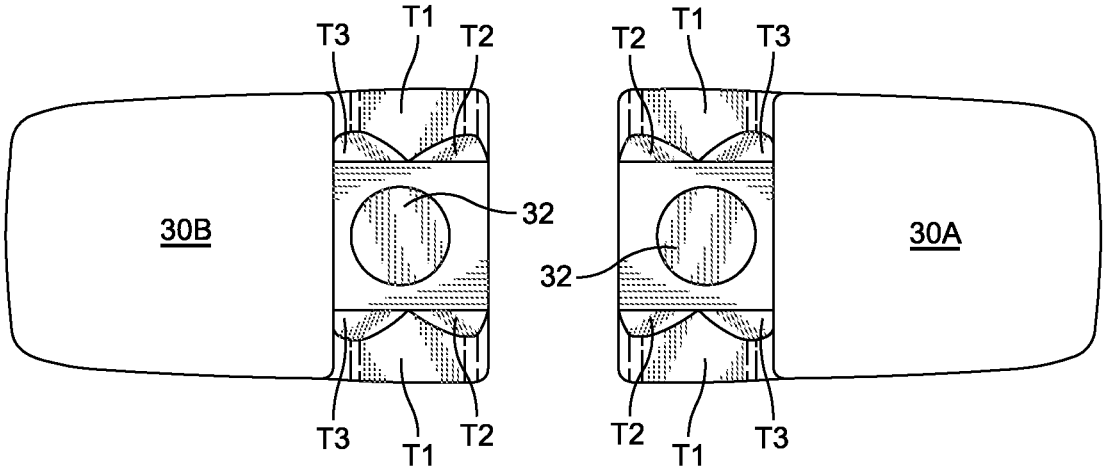
FIG. 13A is a plan view in which the two separate pieces of the clasp are illustrated as to their particular magnet construction and associated tapers and taper directions.

Reference is now made FIGS. 10-13 in connection with another embodiment of the present invention, which is a preferred structure illustrating the various inclined planes, also referred to as tapers. Thus, in FIGS. 10 and 11 there is shown a clasp 30 that is comprised of two clasp housing pieces or halves 30A and 30B. In the cross-sectional view of FIG. 11 the magnets are shown at 32. FIGS. 12 and 13 are exploded perspective views showing further details of the structure. FIG. 13A is a plan view in which the two separate pieces of the clasp are illustrated as to their particular magnet construction and associated tapers and taper directions.

Figure 10:
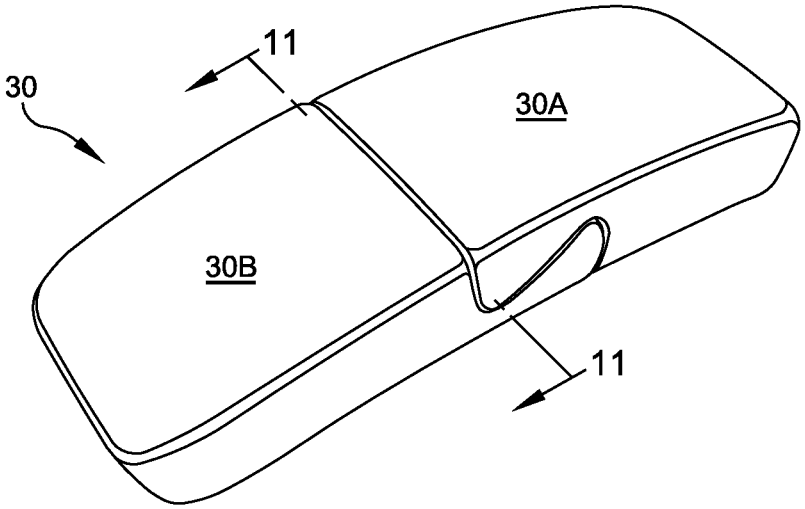
FIG. 10 is a perspective view another embodiment of the present invention.
Figure 11:
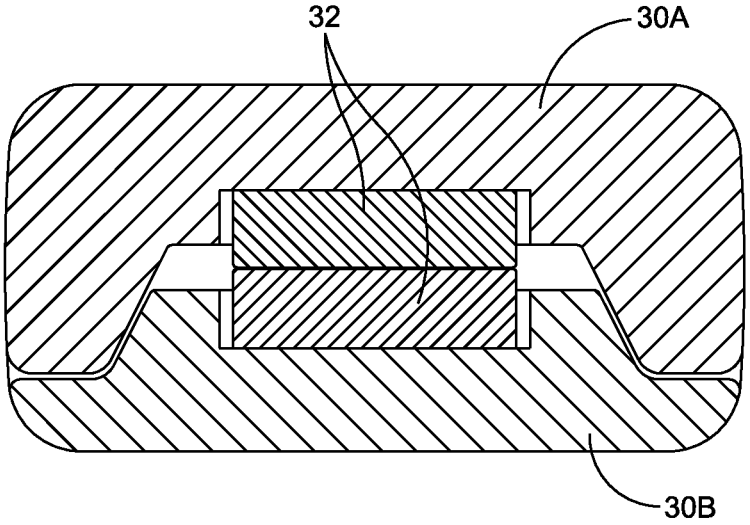
FIG. 11 is a cross-sectional view taken along Line 11-11 of FIG. 10.

With further reference to FIGS. 12, 13, and 13A, it is noted that each of the clasp pieces 30A, 30B has a substantially flat middle planar portion 34 where the magnet 32 is arranged. In FIGS. 12 and 13 the magnet 32 is shown slightly elevated. However, the top of the magnet 32 may be flush with the planar surface 34, or could even be slightly recessed into the planar surface 34, depending on the strength of each magnet. The outer portion of each of the housing pieces or halves is defined by a leg 35 having a taper T1 that may be considered as a taper in the longitudinal direction of the clasp. These tapers interlock in the manner such as illustrated in FIG. 10.

The other inclined planes include inwardly directed tapers or inclines T2 and adjacent thereto are outwardly tapered inclines T3. These various tapers T2 and T3 are matching with respect to the two separate clasp members 30A and 30B. When the clasp members are joined together, tapers T2 of one of the clasp members engage with taper T3 of the other clasp member. This alternating taper arrangement provided by the inclines T2 and T3 provides an enhanced interlocking, particularly with respect to side-to-side motion between the clasp members.

Thus, in accordance with the embodiment illustrated in FIGS. 10-13, the second inclined surface T2 and the third inclined surface T3 are essentially disposed adjacent to each other, both spaced inwardly of each leg 35. Both the second inclined surface T2 and the third inclined surface T3 are directed or slanted in a direction that is substantially transverse to the longitudinal axis X of the clasp. The second inclined surface T2 extends facing inwardly of the clasp housing piece and a third inclined surface T3 extends facing outwardly of the clasp housing piece. Stated in another way, the incline T2 joins at the support surface 34 and is angularly directed upward and away from the support surface 34. The other incline T3, on the other hand, such as illustrated in FIG. 12, joins the support surface 34 but is angularly directed downward and also away from the support surface 34. Also observed in FIGS. 10-13 is the fact that the first inclined surface T1 may be considered as having a lower end 31 and a peak end 33. The second inclined surface T2 extends facing inwardly of the clasp housing piece at the peak end 33 of the first inclined surface T1 and the third inclined surface T3 extends facing outwardly of the clasp housing piece at the lower end 31 of the first inclined surface T1. Each clasp housing piece has a pair of first inclined surfaces that are inclined in the same direction and that are separated by the middle support surface 34 that supports a respective magnetic attraction member.

Figure 14:
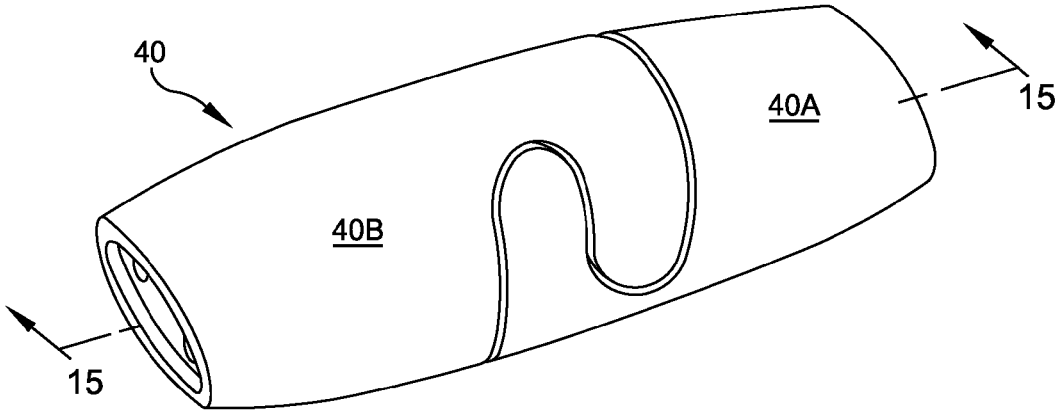
FIG. 14 is a perspective view of still another embodiment of the present invention.
Figure 15:
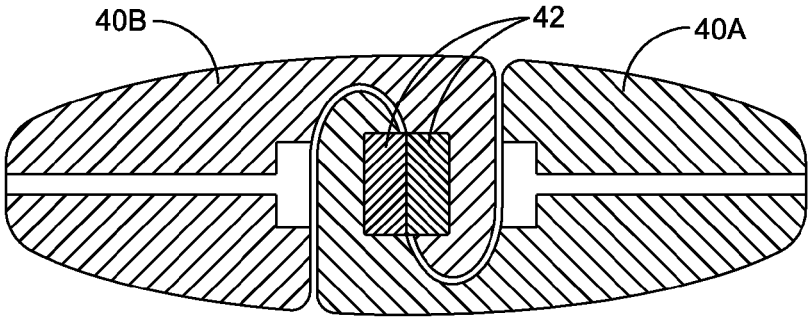
FIG. 15 is a cross-sectional view taken along Line 15-15 of FIG. 14.
Figure 16:
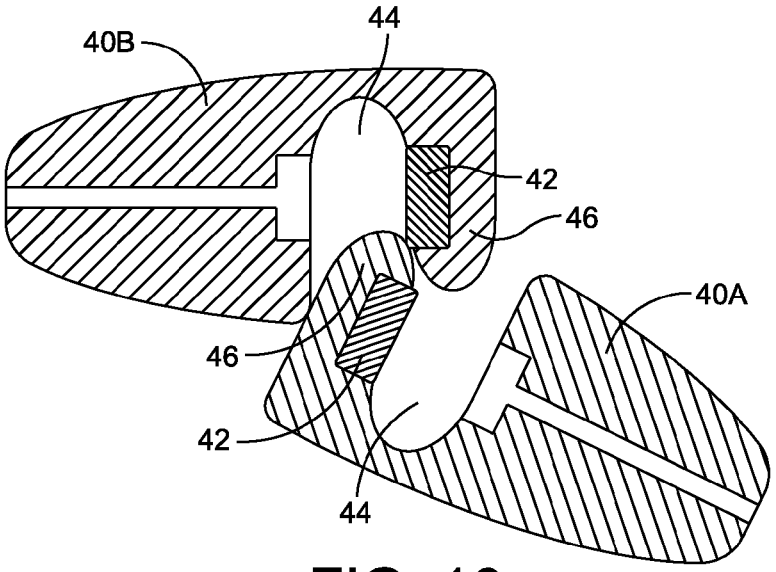
FIG. 16 is a cross-sectional view similar to that illustrated in FIG. 15, but with the clasp members being disengaged.

Reference is to now made to FIGS. 14-16 for an illustration of still another embodiment of the present invention. This includes a clasp body that is comprised of separate clasp members 40A and 40B, each having associated therewith a properly mounted magnet 42. Unlike the embodiment such as illustrated in the cross-sectional view of FIG. 11, in the embodiment illustrated in FIGS. 14-16 the magnets 42 are arranged in a position along a longitudinal axis of the clasp members or housing pieces. This is possible by means of configuring each of the clasp members with a substantial recess 44 and having each of the clasp members include an extending leg 46 that supports the magnet 42. The cross-sectional view of FIG. 15 illustrates this arrangement in an interlock position, while the cross-sectional view of FIG. 16 illustrates the manner in which one of the clasp members may be rotated away from the other clasp member to disengage the contact between the magnets 42. Each interface surface may be considered as essentially S-shaped, and that is formed at least in part by the extending leg 46 in combination with the recess 44.

Figure 17:
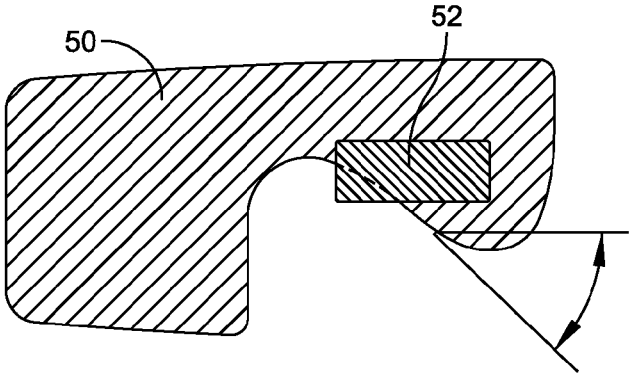
FIG. 17 is a cross-sectional view of an alternate embodiment of a clasp member and magnet.
Figure 18:
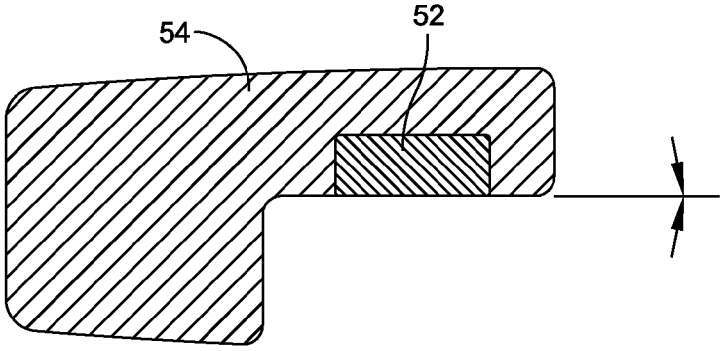
FIG. 18 is a cross-sectional view of another embodiment of a clasp member and magnet.
Figure 19:
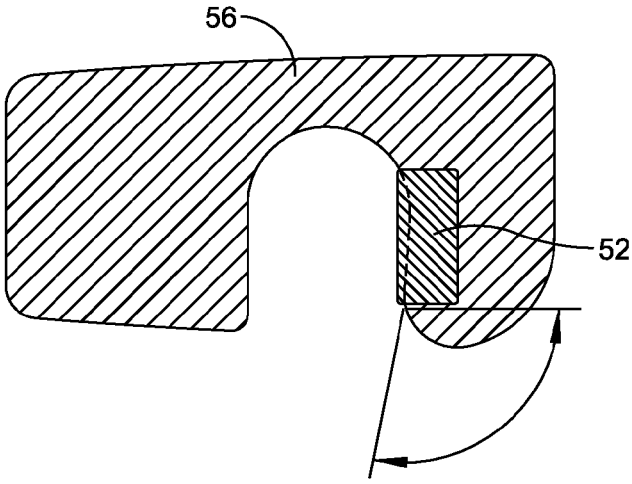
FIG. 19 is a cross-sectional view of still a further embodiment of a clasp member and magnet.

Reference is now made to further possible magnet mounting arrangements as illustrated in alternate views in FIGS. 17-19. In FIG. 17, the magnet 52 is mounted so that it extends slightly outwardly from the clasp member 50. In the cross-sectional view of FIG. 18 the magnet 52 is flush with a wall that defines an outer surface of the clasp member 54. In the fragmentary cross-sectional view of FIG. 18, the magnet 52 is illustrated positioned in a manner similar to that illustrated in FIGS. 15 and 16.

Having now described a limited number of embodiments of the present invention, it should now be apparent to those skilled in the art that numerous other embodiments and modifications thereof are contemplated as falling within the scope of the present invention defined by the appended claims. For example, various types of magnetic attraction members may be employed including one or more magnets or like magnetic attraction pieces.

What is claimed is:

1. A jewelry clasp having a longitudinal axis and comprised of separate, inter-engageable clasp members, each clasp member supporting a magnetic attraction member and having respective interfacing surfaces including a pair of side-disposed legs each having an inclined plane surface and a middle portion disposed between the legs and for support of the magnetic attraction member, said magnetic attraction members each having a substantially planar contact surface that extends along and being coplanar with a plane disposed along the longitudinal axis, said respective interfacing surfaces including at least a first inclined surface that is inclined in a direction of the longitudinal axis, and at least a second inclined surface that is inclined in a direction transverse to the longitudinal axis.

2. The jewelry clasp of claim 1 wherein the at least the second inclined surface includes a second inclined surface and a third inclined surface.

3. The jewelry clasp of claim 2 wherein the second inclined surface and the third inclined surface are disposed adjacent to each other.

4. The jewelry clasp of claim 3 wherein both the second inclined surface and the third inclined surface are directed in a direction transverse to the longitudinal axis of the clasp.

5. The jewelry clasp of claim 1 wherein the middle portion of each clasp member has an internal support surface for the support of a magnetic attraction member, so that in a closed position of the clasp members, each of the contact surfaces are joined along an attraction interface plane between the magnetic attraction members that extends along the longitudinal axis.

6. A jewelry clasp comprised of separate, inter-engageable clasp members, each clasp member supporting a magnetic attraction member and having respective interfacing surfaces including separately disposed inclined plane surfaces about the magnetic attraction member, said separately disposed inclined plane surfaces including at least a first inclined surface that is inclined in a direction longitudinal of the clasp, and at least a second inclined surface that is a directed in a direction transverse to a longitudinal axis of the clasp, wherein the at least the second inclined surface includes a second inclined surface and a third inclined surface, and wherein the second inclined surface extends facing inwardly of the clasp member and the third inclined surface extends facing outwardly of the clasp member.

7. The jewelry clasp of claim 6 wherein the first inclined surface has a lower end and a peak end.

8. The jewelry clasp of claim 7 wherein the second inclined surface extends facing inwardly of the clasp member at the peak end of the first inclined surface and the third inclined surface extends facing outwardly of the clasp member at the lower end of the first inclined surface.

9. The jewelry clasp of claim 6 wherein each clasp member has a pair of first inclined surfaces that are inclined in a same direction and that is separated by a middle portion that supports a respective magnetic attraction member.

10. A jewelry clasp having a longitudinal axis and comprising:

a first clasp housing piece;

a second clasp housing piece;

said first and second clasp housing pieces each having an internal support surface and respective interface surfaces that are constructed and arranged to provide a mating fit between the first and second clasp housing pieces;

a first magnetic attraction member disposed at the internal support surface of the first clasp housing piece; and a second magnetic attraction member disposed at the internal support surface of the second clasp housing piece;

wherein the respective interface surfaces include side-disposed tapered edge pieces on either side of the internal support surface for the magnetic attraction members;

wherein the first and second magnetic attraction members each have a substantially flat contact surface that extends, in a closed position of the housing pieces, coparallel to and along the longitudinal axis;

wherein the side-disposed edge pieces each have a first inclined surface that is inclined in a direction of the longitudinal axis, and at least a second inclined surface that is inclined in a direction transverse to the longitudinal axis.

11. The jewelry clasp of claim 10 wherein the second inclined surface extends facing inwardly of the clasp housing piece and a third inclined surface extends facing outwardly of the clasp housing piece.

12. The jewelry clasp of claim 10 wherein the internal support surface of each housing piece also extends, in a closed position of the housing pieces, in a direction of the longitudinal axis.

13. The jewelry clasp of claim 10 wherein each clasp housing piece includes an elongated channel for receiving a chain, or cord including an end recess.

14. The jewelry clasp of claim 10 wherein the at least the second inclined surface includes a second inclined surface and a third inclined surface.

15. The jewelry clasp of claim 14 wherein the second inclined surface and the third inclined surface are disposed adjacent to each other, and wherein both the second inclined surface and the third inclined surface are directed in a direction transverse to the longitudinal axis of the clasp.

16. A jewelry clasp comprising:

a first clasp housing piece;

a second clasp housing piece;

said first and second clasp housing pieces each having an internal support surface and respective interface surfaces that are constructed and arranged to provide a mating fit between the first and second clasp housing pieces;

a first magnetic attraction member disposed at the internal support surface of the first clasp housing piece; and a second magnetic attraction member disposed at the internal support surface of the second clasp housing piece;

wherein each interface surface is S-shaped and that is formed at least in part by an extending leg; and wherein each of the magnetic attraction members is supported at one of the legs.

17. A jewelry clasp comprising:

a first clasp housing piece;

a second clasp housing piece;

said first and second clasp housing pieces each having an internal support surface and respective interface surfaces that are constructed and arranged to provide a mating fit between the first and second clasp housing pieces;

a first magnetic attraction member disposed at the internal support surface of the first clasp housing piece; and a second magnetic attraction member disposed at the internal support surface of the second clasp housing piece;

wherein the respective interface surfaces include side-disposed inclined plane surfaces on either side of the internal support surface, said side-disposed inclined plane surfaces including at least a first inclined surface that is inclined in a direction of a longitudinal axis of the clasp, and at least a second inclined surface that is a directed in a direction transverse to the longitudinal axis of the clasp;

wherein the at least the second inclined surface includes a second inclined surface and a third inclined surface;

wherein the second inclined surface and the third inclined surface are disposed adjacent to each other, and wherein both the second inclined surface and the third inclined surface are directed in a direction transverse to the longitudinal axis of the clasp; and wherein the second inclined surface extends facing inwardly of the clasp housing piece and a third inclined surface extends facing outwardly of the clasp housing piece.

18. The jewelry clasp of claim 17 wherein the first inclined surface has a lower end and a peak end, and wherein the second inclined surface extends facing inwardly of the clasp housing piece at the peak end of the first inclined surface and the third inclined surface extends facing outwardly of the clasp housing piece at the lower end of the first inclined surface.

* * * * *